US012618288B1

(12) United States Patent
Alrasheed et al.

(10) Patent No.: US 12,618,288 B1
(45) Date of Patent: May 5, 2026

(54) BOTTOM HOLE ASSEMBLY FOR ROTARY DRILLING

(71) Applicant: SAUDI ARABIAN OIL COMPANY, Dhahran (SA)

(72) Inventors: Abdulmalik Alrasheed, Dhahran (SA); Atallah Alharbi, Dhahran (SA); Richard Pye, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/087,237

(22) Filed: Mar. 21, 2025

(51) Int. Cl.

| | |
|---|---|
| ***E21B 4/02*** | (2006.01) |
| ***E21B 4/00*** | (2006.01) |
| ***E21B 7/18*** | (2006.01) |
| ***F04B 1/2078*** | (2020.01) |

(52) U.S. Cl.
CPC ..... *E21B 4/02* (2013.01); *E21B 4/006* (2013.01); *E21B 7/18* (2013.01); *F04B 1/2078* (2013.01)

(58) Field of Classification Search
CPC ..... E21B 7/18; E21B 4/02
See application file for complete search history.

(56) References Cited

U.S. PATENT DOCUMENTS

| | | | | |
|---|---|---|---|---|
| 3,112,800 | A * | 12/1963 | Bobo | E21B 10/605 175/403 |
| 8,074,744 | B2 | 12/2011 | Watson et al. | |
| 9,540,881 | B2 | 1/2017 | Guan et al. | |
| 11,512,536 | B2 | 11/2022 | Portwood et al. | |
| 2006/0113114 | A1* | 6/2006 | Jin | E21B 7/18 175/93 |
| 2021/0140245 | A1* | 5/2021 | Portwood | E21B 7/18 |
| 2021/0231112 | A1 | 7/2021 | Kawakita et al. | |
| 2022/0316288 | A1* | 10/2022 | Johnson | E21B 4/02 |
| 2024/0191576 | A1 | 6/2024 | Bataweel et al. | |
| 2025/0237111 | A1* | 7/2025 | Zahir Sulaiman Al-Shukaili | E21B 7/18 |

FOREIGN PATENT DOCUMENTS

| | | | |
|---|---|---|---|
| CN | 2665342 Y | | 12/2004 |
| CN | 201265360 Y | * | 7/2009 |
| CN | 204476279 U | | 7/2015 |

(Continued)

OTHER PUBLICATIONS

English Translation of CN201265360 (Year: 2025).*

*Primary Examiner* — Giovanna Wright
(74) *Attorney, Agent, or Firm* — Vorys, Sater, Seymour and Pease LLP

(57) ABSTRACT

A bottom hole assembly includes a housing, a drill bit, a first flow path, a pump, a power source, and a second flow path. The housing defines a flow channel therethrough for receiving a fluid from a drill string. The first flow path being defined through the drill bit between a first inlet port and a first nozzle, the first inlet port fluidly coupled to the flow channel. The pump being disposed in the housing and having a pump inlet fluidly coupled to the flow channel, the pump being configured to pressurize a fluid and discharge the fluid through a pump outlet. The power source being coupled to the housing and operable to drive the pump. The second flow path being defined through the drill bit and extending between a second inlet port and a second nozzle, the second inlet port fluidly coupled to the pump outlet.

13 Claims, 7 Drawing Sheets

(56) References Cited

FOREIGN PATENT DOCUMENTS

| | | | |
|---|---|---|---|
| CN | 206111095 | U | 4/2017 |
| CN | 107386979 | A | 11/2017 |
| CN | 207229013 | U | 4/2018 |
| CN | 109025831 | A | 12/2018 |
| CN | 115949345 | A | 4/2023 |
| KR | 101871306 | B1 | 6/2018 |
| KR | 102067515 | B1 | 1/2020 |

* cited by examiner

BOTTOM HOLE ASSEMBLY FOR ROTARY DRILLING

FIELD OF THE DISCLOSURE

The present disclosure relates generally to drilling subterranean wellbores and, more particularly, to drilling tools and methods for discharging a pressurized fluid from a drill string through a nozzle of a drill bit.

BACKGROUND OF THE DISCLOSURE

Wellbores may be drilled to recover natural deposits of oil and gas, as well as other desirable materials that are trapped in subterranean geological formations. A drill string with a rotary drill bit may be used to drill the wellbores through the geologic formations. A drilling fluid may be circulated through the drill string and may be discharged through nozzles in the drill bit to lubricate the drill bit and to carry geologic cuttings back to a surface location.

Some geologic formations are difficult for the drill bit to penetrate due to the composition of the rocks and stresses present in the geologic formation. Some geologic formations, for example, are highly stressed due to the overburden of the rock above the geologic formation. The high stress in the geologic formation decreases the rate of penetration of the drill bit.

There is a need in the art for improving the rate of penetration of the drill bit.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a bottom hole assembly includes a housing, a drill bit, a first flow path, a pump, a power source, and a second flow path. The housing being conveyable into a wellbore on a drill string and defining a flow channel therethrough for receiving a fluid from the drill string. The drill bit being coupled to the housing and operable to rotate to drill a geologic formation and thereby extend the wellbore. The first flow path being defined through the drill bit between a first inlet port and a first nozzle, the first inlet port fluidly coupled to the flow channel to permit a first portion of the fluid received from the drill string to flow through the first flow path and exit the drill bit through the first nozzle. The pump being disposed in the housing and having a pump inlet fluidly coupled to the flow channel to receive a second portion of the fluid received from the drill string, the pump being configured to pressurize the second portion of the fluid and discharge the second portion of the fluid through a pump outlet. The power source being coupled to the housing and operable to drive the pump. The second flow path being defined through the drill bit and distinct from the first flow path, the second flow path extending between a second inlet port and a second nozzle, the second inlet port fluidly coupled to the pump outlet to permit the pressurized second portion of the fluid to flow through the second flow path and exit the drill bit through the second nozzle.

According to an embodiment consistent with the present disclosure, a well system includes a drill string disposable in a wellbore, a housing, a drill bit, a first flow path, a pump, and a power source, and a second flow path. The housing being coupled to a downhole end of the drill string and defining a flow channel therethrough for receiving a fluid from the drill string. The drill bit being coupled to the housing and operable to drill a geologic formation and thereby extend the wellbore. The first flow path being defined through the drill bit between a first inlet port and a first nozzle, the first inlet port fluidly coupled to the flow channel to permit a first portion of the fluid received from the drill string to flow through the first flow path and exit the drill bit through the first nozzle. The pump being disposed in the housing and having a pump inlet fluidly coupled to the flow channel to receive a second portion of the fluid received from the drill string, the pump being configured to pressurize the second portion of the fluid and discharge the second portion of the fluid through a pump outlet. The power source being coupled to the housing and operable to drive the pump. The second flow path being defined through the drill bit and distinct from the first flow path, the second flow path extending between a second inlet port and a second nozzle, the second inlet port fluidly coupled to the pump outlet to permit the pressurized second portion of the fluid to flow through the second flow path and exit the drill bit through the second nozzle.

According to an embodiment consistent with the present disclosure, a method of drilling a geologic formation includes rotating a drill string to rotate a drill bit at a downhole end of the drill string against the geologic formation. The method further includes pumping a fluid downhole through the drill string using a surface pump while rotating the drill string. The method further includes discharging a first portion of the fluid from a first nozzle of the drill bit at a first discharge pressure. The method further includes flowing a second portion of the fluid into a pump disposed in the drill string. The method further includes driving the pump using a power source coupled to the drill string to thereby discharge the second portion of the fluid from the pump into a flow path of the drill bit while rotating the drill string. The method further includes discharging the second portion of the fluid from a second nozzle of the drill bit at a second discharge pressure greater than the first discharge pressure.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
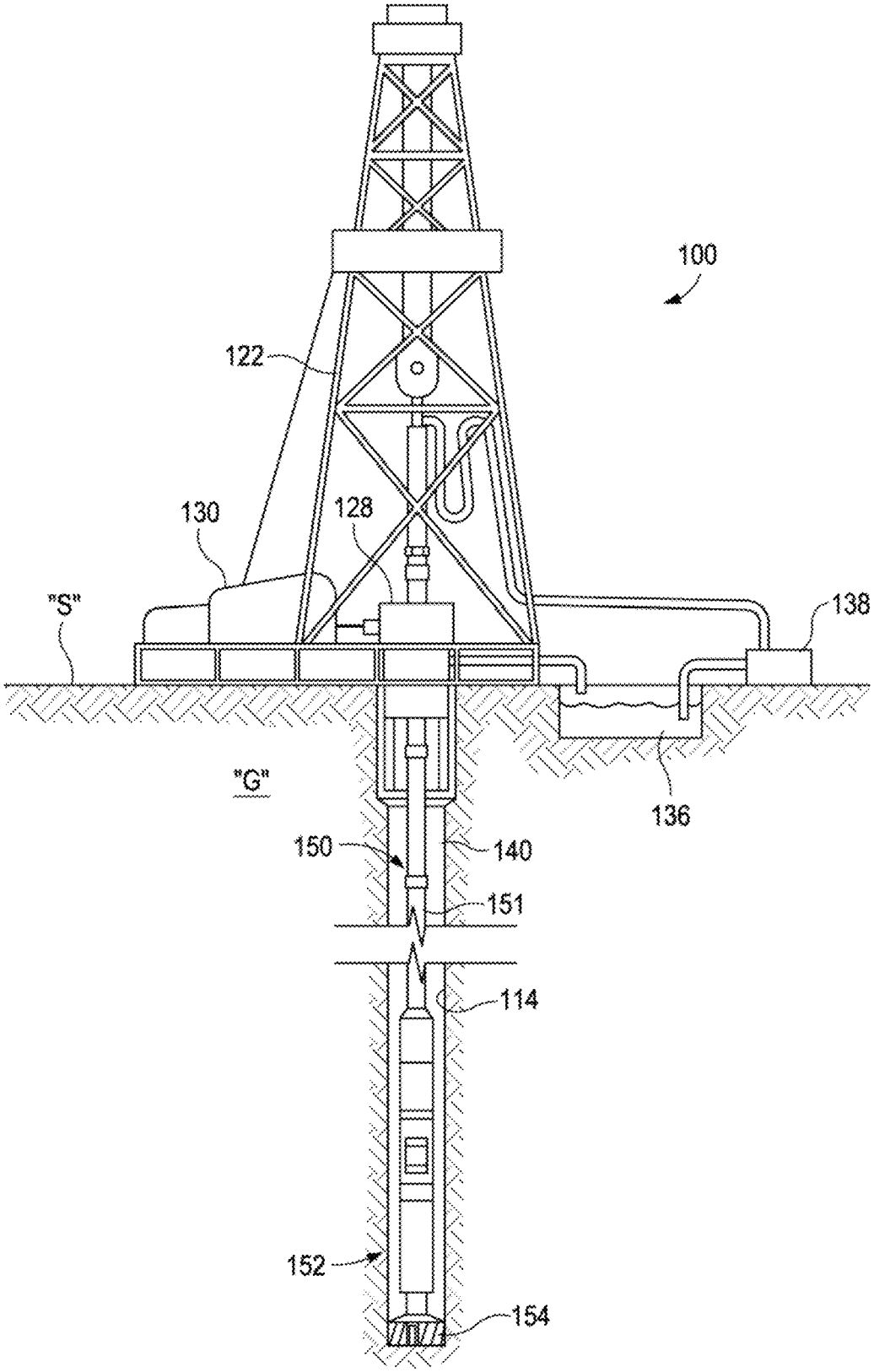
FIG. 1 is a partial cross-sectional side view of an example drilling system including a bottom hole assembly (BHA) having a rotary drill bit constructed in accordance with one or more exemplary embodiments of the disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to drilling wellbores in a geologic formation, and more particularly to drilling tools and methods for discharging a pressurized fluid through a nozzle of a drill bit. More specifically, a drill string including a bottom hole assembly ("BHA") may be rotated to drive rotation of a drill bit at the downhole end of the drill string. A drilling fluid, or "mud," may be pumped through the drill string from a surface location, and a portion of the mud flowing through the drill string enters into a pump disposed in the bottom hole assembly. The pump is driven by a downhole power source carried by the drill string, such as being part of the bottom hole assembly. The power source may generate power in response to the mud flowing through the drill string. The power source, however, does not necessarily drive rotation of the drill bit since the drill bit may be rotated by the drill string. The pump operates to increase a pressure of the portion of the mud, which is expelled as a fluid jet out of at least one high-pressure nozzle of the drill bit at a desired discharge pressure. The fluid jet discharged from the high-pressure nozzle releases stresses within the geologic formation which increases the rate of penetration of the drill bit. A remainder of the mud flowing through the drill string may flow out of at least one low-pressure nozzle formed in the drill bit.

Figure 2:
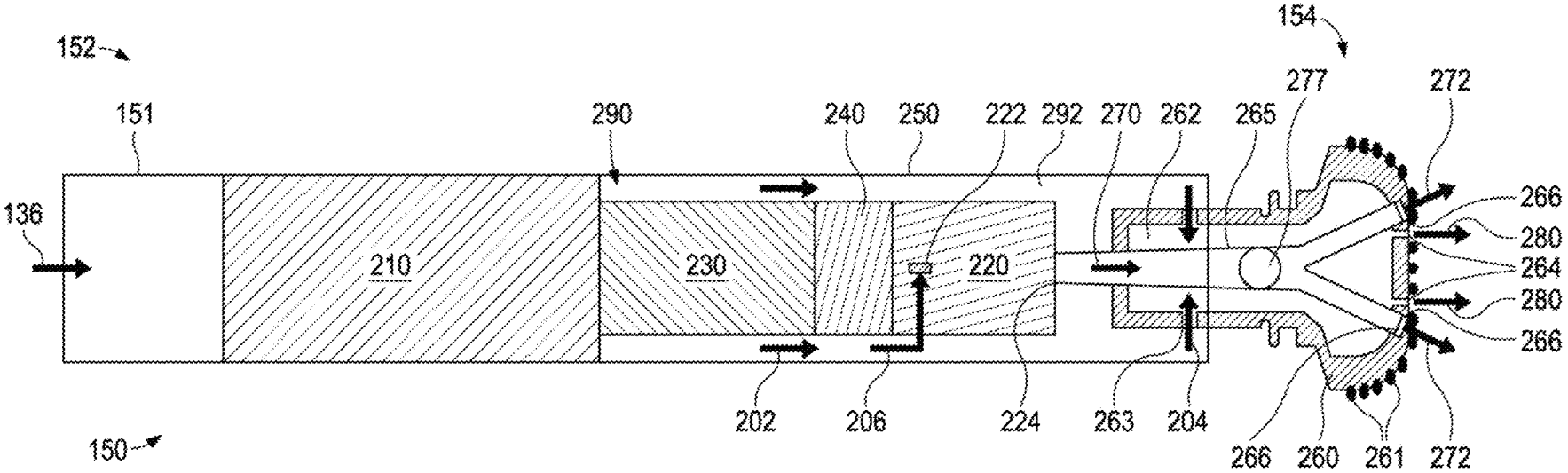
FIG. 2 is a schematic, cross-sectional view of the BHA of FIG. 1 in accordance with one or more exemplary embodiments of the disclosure.

FIG. 1 illustrates an example of a drilling system 100 that may incorporate a drill string 150 including a bottom hole assembly 152 (often hereinafter referred to as a "BHA") constructed in accordance with one or more exemplary embodiments of the disclosure. An exemplary embodiment of the bottom hole assembly is shown in FIG. 2. The drill string 150 is partially disposed within a wellbore 114 extending from a surface location "S" and traversing a geologic formation "G." In the illustrated example, the wellbore 114 is shown generally vertical, though it will be understood that the wellbore 114 may include any of a wide variety of vertical, directional, deviated, slanted and/or horizontal portions therein, and may extend along any trajectory through the geologic formation "G."

The bottom hole assembly 152 includes a drill bit 154 at a lower end thereof for cutting through the geologic formation "G." Rotating the drill string 150 causes the drill bit 154 to break up and generally disintegrate the geological formation "G." The drill string 150 may include a plurality of joints of drill pipe 151 assembled together and connected to the uphole end of the bottom hole assembly 152. The length of the drill string 150 is increased during drilling by adding additional joints of drill pipe 151.

The drill string 150 may be rotated in a variety of ways. In this example, a drilling rig 122 at the surface location "S" includes a rotary table 128 that may be operated to rotate the entire drill string 150 and the drill bit 154. The rotary table 128 is selectively driven by a motor or engine 130, chain-drive system, or other apparatus. In other embodiments, the drilling rig 122 may include a top drive (not shown) configured to rotate the drill string 150 to advance the drill bit 154.

The drilling system 100 may include a mud pump 138 (e.g., a surface pump) that pumps mud 136 (e.g., drilling mud) downhole through an interior of the drill string 150. The mud 136 passes through a flow channel (see flow channel 290 in FIG. 2) of the BHA 152 before being discharged (e.g., expelled) through one or more low-pressure nozzles (see low-pressure nozzles 264 in FIG. 2) defined in the drill bit 154. The discharged mud 136 flushes geologic cuttings and/or other debris from the path of the drill bit 154 as the mud 136 returns to the surface through an annulus 140 defined between the drill string 150 and the geologic formation "G." The geologic cuttings and other debris are carried by the mud 136 to the surface location "S" where the cuttings and debris can be removed from the mud stream.

The geologic formation "G" encountered by the drill bit 154 may be highly-stressed due to overburden which slows the rate of penetration during drilling. According to embodiments of the present disclosure, the BHA 152 may include a pump (see pump 220 in FIG. 2) operable to pump a portion of the mud 136 flowing downhole through the drill string 150 out of one or more high-pressure nozzles (see high-pressure nozzles 266 in FIG. 2) to at least partially release stresses within the geologic formation "G" to improve the rate of penetration of the drill bit 154.

FIG. 2 schematically illustrates an embodiment of the BHA 152 employed in the drilling system 100 of FIG. 1. The BHA 152 is shown connected to a downhole end of a joint of drill pipe 151, and generally includes a power source 210, a pump 220, a transmission 230, a torque limiter 240 and the drill bit 154. In some embodiments, the transmission 230 and/or torque limiter 240 may be omitted. The drill bit 154 may be fixed to a housing 250 of the BHA 152 such that the drill 154 bit rotates along with the drill string 150.

The power source 210 is operative to supply power, such as electrical or rotational power, to drive the pump 220. The power source 210 may be any suitable power source operable to drive the pump 220, such as a mud motor, a mud turbine, a solenoid, or an electric motor. In the illustrated embodiment, the power source 210 is fluidly coupled to the drill pipe 151 to receive the mud 136 therefrom. The power source 210 may extract energy from the mud 136 before the mud 136 exits the power source 210 as indicated by arrow 202. As an example, the power source 210 may be a mud motor (see mud motor 310 in FIG. 3) that includes a rotor and a stator. The rotor may be rotated in response to the flow of the mud 136 through the mud motor, and the rotational power generated by the rotor may be transmitted through the transmission 230 to drive the pump 220. A number of stages, length, and/or number of lobes of the stator and/or rotor of the mud motor may be selected based on the desired torque output of the mud motor. As another example, the power source 210 may be a mud turbine with one or more sets of stators and rotors having blades. The flow of mud 136 through the mud turbine interacts with the blades to rotate the rotors and an output shaft coupled thereto relative to the stators. The output shaft of the mud turbine may be used to drive the pump 220.

In other embodiments, the mud 136 may bypass (flow around) the power source 210, and the power source 210 may be configured to drive the pump 220 without extracting energy from the mud 136. For example, the power source 210 may be a rotary solenoid to supply rotational power to the pump 220 or a linear solenoid that is operable to reciprocate the pump 220. As another example, the power source 210 may be an electric motor that provides rotational power to the pump 220 in some embodiments. Electric power to the solenoid or the electric motor may be supplied from the surface location "S" (FIG. 1) or may be generated by a downhole generator incorporated into the drill string 150. For example, a downhole generator may be incorporated into BHA 152 that converts the flow of the mud 136 to electrical power. The power source 210 may be an electric motor that is powered by a generator coupled to a mud turbine.

The pump 220 is configured to receive a portion of the mud 136 flowing (arrow 202) through a flow channel 290 into a pump inlet 222, as indicated by arrow 206. The pump 220 pressurizes the mud 136 and discharges the mud into a second flow path 265 formed in the drill bit 154 represented by arrow 270. As will be discussed in more detail below, the mud 136 pumped into the second flow path 265 is discharged from high-pressure nozzles 266 of the drill bit 154 as represented by arrow 272.

The pump 220 may be any suitable type of pump. For example, the pump 220 may be a reciprocating pump (e.g., reciprocating piston), a swash pump (see swash pump 520 in FIG. 5), a rotary pump, a screw pump, an internal gear pump, an external gear pump, a rotary vane, a plunger pump, a diaphragm pump, or a circumferential piston pump. The pump 220 may be used to repeatedly pump small volumes (e.g., a few gallons) of the mud 136 entering an inlet 222 of the pump 220 out of an outlet 224 thereof that is fluidly coupled to the second flow path 265. Additionally, the pump 220 may be configured to provide a desired flow rate to achieve a desired discharge pressure of the mud 136 from the high-pressure nozzles 266 to facilitate breaking up the geologic formation "G."

The flow channel 290 extends from an uphole end of the BHA 152 to the drill bit 154 to allow the mud 136 to flow through the BHA 152. The flow channel 290 is at least partially defined by the housing 250. The flow channel 290 may be a combination of annuli between the housing 250 and other components of the BHA and other flow paths within components of the BHA 150. In embodiments where the power source 210 extracts energy from the mud 136, the flow channel 290 is at least partially defined by a flow path through the power source 210, such as the flow path between the rotor and stator of the mud motor. In embodiments where the mud 136 bypasses the power source 210, the flow channel 290 may include one or more channels, bores, annuli, or conduits that facilitate the flow of mud 136 around the power source 210. A portion of the flow channel 290 may be defined by an annulus 292 between the housing 250 and the pump 220 as shown in FIG. 2.

In the embodiment illustrated in FIG. 2, the pump inlet 222 is located downhole and downstream of the power source 210 within the housing 250. The pump inlet 222 may receive the mud 136 from the annulus 292. In some other embodiments, the pump inlet 222 may receive mud 136 that bypasses the power source 210, such as by receiving the mud 136 through a bypass conduit (see bypass conduit 360 in FIG. 3) that has one end connected to the pump inlet 222 and a second end arranged in a portion of the flow channel 290 that is uphole and upstream of the intake of the power source 210. In embodiments where the power source 210 extracts energy from the mud 136, the power source 210 may cause a pressure drop in the mud 136, with the mud 136 uphole of the power source 210 having a higher pressure than the mud 136 downhole of the power source 210. Receiving the higher-pressure mud uphole of the power source 210 reduces the amount of energy required by the pump 220 to achieve the desired discharge pressure from the high-pressure nozzles 266. The bypass conduit connected to the pump inlet 222 may be disposed exterior of the housing 250. In some embodiments, the pump inlet 222 may be connected to a flow path through the power source 210, such as a flow path through a rotor of the mud motor or shaft of the mud turbine, that allows a portion of the higher-pressure mud 136 uphole of the power source 210 to enter the pump 220.

In some embodiments, the BHA 152 includes the transmission 230 operably coupled between the power source 210 and the pump 220 to transfer the power from the power source 210 to the pump 220. The transmission 230 may include one or more gears (e.g., bevel gears) or cam follower mechanisms. In some embodiments, the transmission 230 may convert the rotational output of the power source 210 to a linear motion, such as a reciprocating linear motion that reciprocates the pump 220. For example, in embodiments where the power source 210 includes a mud motor, a rotor of the mud motor may rotate about an axis that is eccentric to a longitudinal axis of the stator by a fixed value. The transmission 230 may convert an eccentric (e.g., nutated) rotation of the rotor due to the eccentricity to a linear reciprocating motion used to reciprocate the pump 220. In other embodiments, the transmission 230 may convert the eccentric rotation of the rotor to rotational power to rotate a shaft of the pump 220 about a longitudinal axis.

In some embodiments, the power source 210 provides power directly to the pump 220 without an interposing transmission 230, such an output member (e.g., output shaft, reciprocating shaft) directly interacting with the pump 220. For example, the output shaft of the power source 210 may be directly connected to a rotary shaft of a swash pump.

In some embodiments, the BHA 152 includes a torque limiter 240 operably coupled between the power source 210 and the pump 220 to limit the torque transfer from the power source 210 to the pump 220. The torque limiter 240 may be any suitable torque limiting device, such as a ball detent mechanism, pawl and spring mechanism, or friction plates. The torque limiter 240 may be coupled at the interface between the pump 220 and the transmission 230 and may facilitate continued operation of the power source 210 once a torque threshold is reached. For example, the pump 220 may fail during a drilling operation causing the torque threshold to be reached or exceeded. Without a torque limiter, the failed pump 220 may inhibit mud flow through the power source 210. For example, the failed pump 220 may cause a mud motor of the power source to stall which causes a pressure increase in the mud 136 and inhibits flow of the mud 136 through the BHA 152. Conventional methods of addressing a stalled mud motor may be ineffective. Stopping the mud flow and lifting the drill bit 154 off the bottom of the hole will not correct the mud motor stall here as the mud motor may not drive the rotation of the drill bit 154 (rotation of the drill string 150 may drive rotation of the drill bit 154 rather than the mud motor). Instead, the torque limiter 240 disconnects or otherwise reduces the transfer of power from the transmission 230 to the pump 220 once the torque threshold is reached which permits continued flow of the mud 136 through the power source 210 despite the pump failure. For example, where the power source 210 includes a mud motor, the torque limiter 240 allows the rotor of the mud motor to rotate relative to the failed pump 220.

The drill bit 154 includes a bit body 260 with a plurality of cutting elements 261 that cut the geologic formation "G" encountered by the drill bit 154. The cutting elements 261 may be polycrystalline diamond ("PCD") cutters. The bit body 260 may be rotationally fixed to the housing 250 such that rotation of the BHA 152 causes the drill bit 154 to rotate.

The bit body 260 defines at least one first flow path 262 (e.g., a low-pressure flow path) connected to one or more low-pressure nozzles 264. The at least one first flow path 262 is in fluid communication with the flow channel 290. For example, each first flow path 262 may include one or more inlet ports 263 defined in the bit body 260 to receive mud 136 from the flow channel 290.

The drill bit 154 also includes the second flow path 265 (e.g., a high-pressure flow path) that extends to one or more high-pressure nozzles 266 formed in or attached to the bit body 260. The high-pressure nozzles 266 may be located at the center of the cutting face of the drill bit 154. In other embodiments, the high-pressure nozzles 266 may be arranged off-center, such as being in a staggered arrangement. The second flow path 265 may be at least partially defined by the bit body 260. In other embodiments, the second flow path 265 may be a conduit disposed within the bit body 260, such as within the first flow path 262. A check valve 277, such as a check ball, may be disposed within the second path 265 to inhibit backflow through the high-pressure nozzles 266. The second flow path 265 is fluidly coupled to the pump 220.

In operation, as shown in FIG. 2, the mud 136 may flow downhole through the drill string 150 and through the flow channel 290 of the BHA 152. As discussed above, the mud 136 may be used by the power source 210 to drive the pump 220. The mud 136 exists the power source 210 and enters the annulus 292 as represented by arrow 202 and continues to flow downhole through the housing 250 of the BHA 152. A portion of the mud 136 flowing through the BHA 152 enters one of the first flow paths 262 through the inlet ports 263 as indicated by arrow 204 before being subsequently discharged from the drill bit 154 through the low-pressure nozzles 264 as represented by arrows 280. The mud 136 discharged from the drill bit 154 facilitates drilling by removing the cuttings and by lubricating the cutting elements 261.

A portion of the mud 136 enters the pump inlet 222 as represented by arrow 206. The pump 220 pumps (pressurizes) the portion of the mud 136 that enters the inlet 222 out of the pump outlet 224. The outlet 224 of the pump 220 is fluidly connected to the second flow path 265 such that the pump 220 discharges the mud 136 into the second flow path 265 as represented by the arrow 270. The mud 236 flows through the second flow path 265 and is subsequently discharged from the high-pressure nozzles 266 as represented by arrows 272. The mud 136 discharged from the high-pressure nozzles 266 cuts and/or breaks up the geologic formation "G" to release stress to improve the rate of penetration of the drill bit 154. The discharge pressure of the mud from the high-pressure nozzles 266 is a function of various factors including the flow rate provided by the pump 220, the density of the mud 136, and the diameter of the high-pressure nozzles 266. In some embodiments, the discharge pressure of the mud from the high-pressure nozzles 266 is at least 10,000 psi, such as exceeding 10,000 psi (68947.57 kPa). By contrast, the mud 136 discharged from the low-pressure nozzles 264 has a low-pressure, such as having a discharge pressure of 2,000 psi (13789.51 kPa) or less. The diameter of the high-pressure nozzles 266 may be selected to facilitate achieving the desired discharge pressure, such as a discharge pressure of 10,000 psi or more. The mud 136 discharged from the high-pressure nozzles 266 mixes with the mud 136 discharged from the low-pressure nozzles 264 and is circulated uphole through the annulus 140 along with the cuttings.

In some embodiments, the drill bit 154, the pump 220, the transmission 230, and the torque limiter 240 are at least partially disposed in the housing 250. For example, the drill bit 154, the pump 220, and the transmission 230 may be part of a first sub of the BHA 152 that is connected to a downhole end of a second sub of the BHA 152 that includes the power source 210. In other embodiments, the power source 210 may also be disposed within the housing 250.

In some embodiments, the transmission 230 is integral to the power source 210. For example, the power source 210 and transmission may be part of a mud motor sub that is coupled to the pump 220, such as the pump 220 and the drill bit 154 being incorporated into a separate sub that is connected to the downhole end of the mud motor sub. In some embodiments, the transmission 230 may at least partially extend from the mud motor sub into the separate sub.

Figure 3:
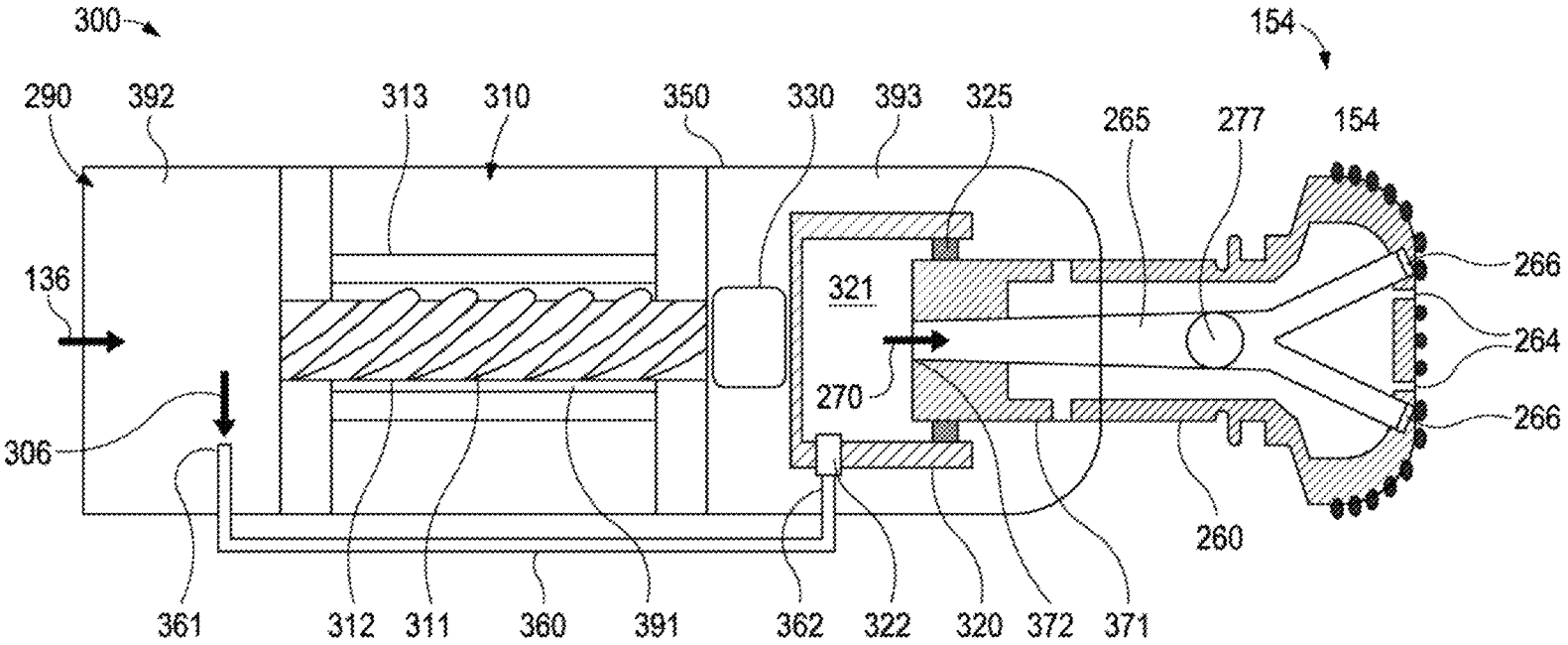
FIG. 3 is a schematic, partial cross-sectional view of an alternate embodiment of a BHA that may be employed in place of the BHA of FIG. 2 in accordance with one or more exemplary embodiments of the disclosure.

FIG. 3 illustrates an example BHA 300 in accordance with one or more exemplary embodiments of the disclosure. The BHA 300 may be substituted for the BHA 152 of FIG. 1. The BHA 300 includes a mud motor 310, a reciprocating piston pump 320, and drill bit 154. The mud motor 210 and reciprocating piston pump 320 are disposed in a housing 350 which may be conveyed into a wellbore 114 on a drill string 150 (FIG. 1) as described above. The drill bit 154 is partially disposed within the housing 350 and may be rotationally fixed to the housing 350. Rotation of the drill string 150 and/or the BHA 300 may cause the drill bit 154 to rotate.

The mud motor 310 is the power source of the BHA 300, which drives the pump 320. The mud motor 310 includes a rotor 311 with a plurality of lobes 312 that is rotatable within a stator 313 in response to the flow of mud 136 through the flow channel 290 formed within the housing 350. In this embodiment, the flow channel 290 includes a flow path 391 between the rotor 311 and the stator 313 that connects a first portion 392 of the flow channel 290 uphole of the mud motor 310 to a second portion 393 of the flow channel 290 that is downhole of the mud motor 310. The eccentric rotation of the rotor 311 is converted to a reciprocating linear motion by the transmission 330 that interposes the mud motor 310 and the reciprocating piston pump 320.

The bit body 260 is partially received within the reciprocating piston pump 320. The reciprocating piston pump 320 includes an interior pump chamber 321 that is partially defined by an interior surface 323 of the reciprocating piston pump 320 and an exterior surface 371 of the bit body 260. In some embodiments, the interior pump chamber 321 may further be partially defined by one or more seal elements 325 that seal an interface between the interior surface 323 of the piston pump 320 and the exterior surface 371 of the bit body 260. The reciprocating piston pump 320 axially reciprocates relative to the bit body 260 in response to the reciprocating motion of the transmission 330 to pump the mud 136 through the second flow path 265 and out the high-pressure nozzles 266. The interior pump chamber 321 decreases in volume during a discharge stroke of the reciprocating piston 320 and increases in volume during an intake stroke of the reciprocating piston 320.

When the reciprocating piston pump 320 is moved in an uphole direction (e.g., intake stroke), the check valve 277 closes and mud 136 flows into an interior pump chamber 321 through the inlet 322. When the reciprocating piston pump 320 is moved in the downhole direction (e.g., discharge stroke), the mud 136 within the interior pump chamber 321 is pumped into an inlet 372 of the second flow path 265 as indicated by the arrow 270 and subsequently discharged out of the high-pressure nozzles 266. The inlet 372 may be an inlet port formed in the bit body 260. The inlet 372 is the outlet of the pump 320 in addition to being the inlet to the second flow path 265. The check valve 277 may be configured to open during the discharge stroke. The pump inlet 322 may include a check valve that inhibits flow out of the pump chamber 321 during the discharge stroke.

The BHA 300 includes a bypass conduit 360 that is partially disposed outside of the housing 350. The bypass conduit 360 includes a first end 361 arranged uphole (upstream) of the mud motor 310 and a second end fluidly connected to the inlet 322. The first end 361 is in fluid communication with the first portion 392 of the flow channel 290 through the BHA 300 uphole of the intake of the mud motor 310. The bypass conduit 360 connects the reciprocating piston pump 320 to the uphole side of the mud motor 310 which has a higher pressure than the mud 136 downhole of the mud motor 310. A portion of the mud 136 represented by arrow 306 flows to the reciprocating piston pump 320 through a second end 362 of the bypass conduit 360 arranged uphole of the mud motor 310 rather than flowing through the mud motor 310. The remainder of the mud 136 flows from the first portion 392 to the second portion 393 through the flow path 391 of the mud motor 310 before subsequently being discharged from the low-pressure nozzles 264 of the drill bit 154. Receiving the higher-pressure mud uphole of the mud motor 310 into the reciprocating piston 320 decreases the amount of work necessary to achieve the desired discharge pressure from the high-pressure nozzles 266.

Figure 4A:
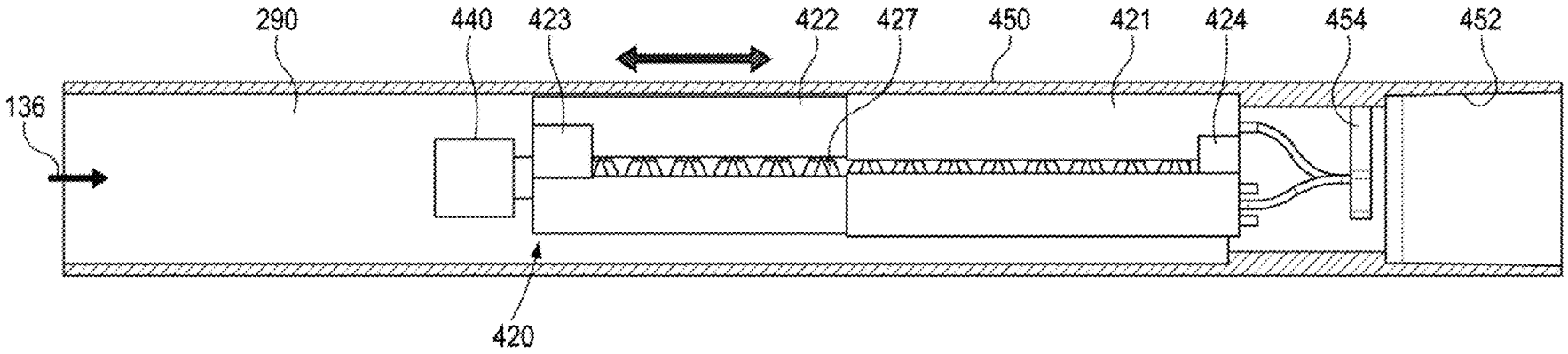
FIG. 4A is a partial cross-sectional view of a pump sub having a pump arranged in a first configuration after an intake stroke in accordance with one or more exemplary embodiments of the disclosure.
Figure 4B:
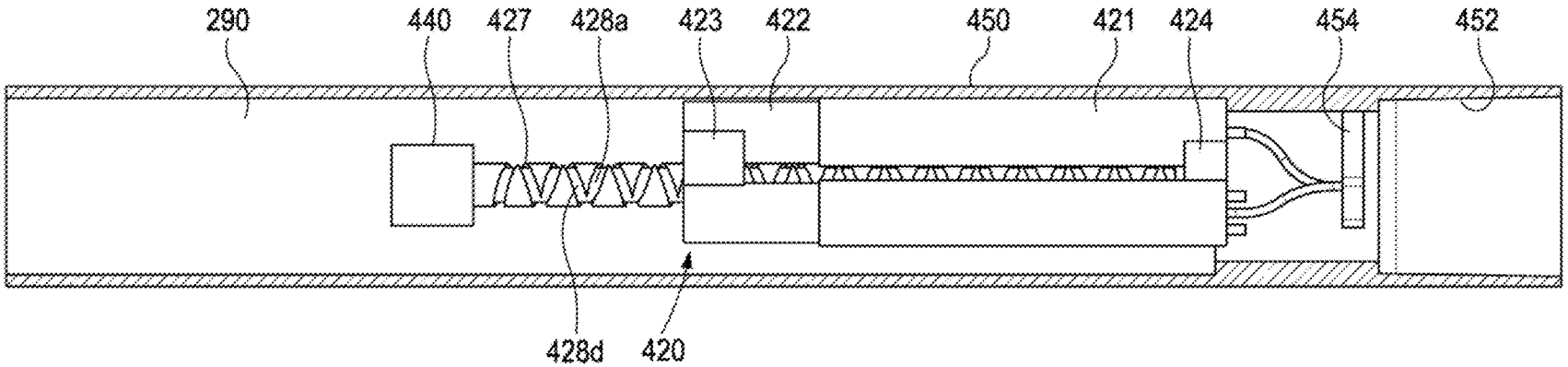
FIG. 4B is a partial cross-sectional view of the pump sub of FIG. 4A arranged in a second configuration after a discharge stroke in accordance with one or more exemplary embodiments of the disclosure.
Figure 4C:
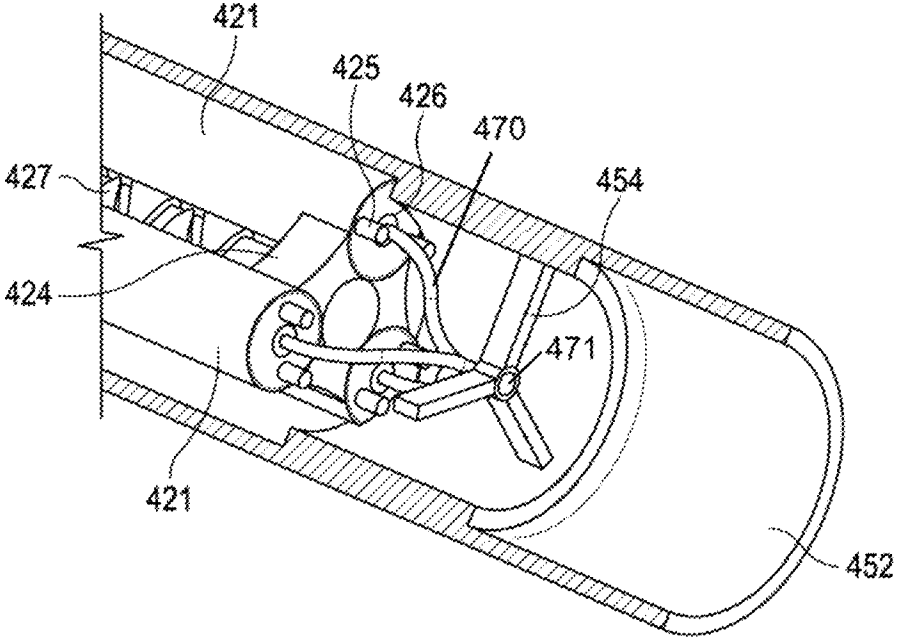
FIG. 4C is partial, cross-sectional perspective view of a discharge portion of the pump sub of FIG. 4A in accordance with one or more exemplary embodiments of the disclosure.

FIGS. 4A-4C illustrate an exemplary pump sub 400 that may be incorporated into a BHA in accordance with one or more exemplary embodiments of the disclosure. The pump sub 400 may be incorporated into a drill string, such as drill string 150, and the rotation of the drill string may cause rotation of the drill bit 154. The pump sub 400 may be connected to the power source 210 in FIG. 1. The pump sub 400 includes a pump 420 disposed within a housing 450. The housing 450 includes a downhole coupling 452 configured to receive the drill bit 154 which is not shown in FIGS. 4A-4C.

The pump 420 is configured to pump a portion of the mud 136 flowing through the flow channel 290 of the pump sub 400 into the second flow path 265 that is subsequently discharged from the one or more high-pressure nozzles 266 in the drill bit 154 at a discharge pressure. The remainder of the mud 136 flows past the pump 420 where the mud 136 is ultimately discharged from the low-pressure nozzles 264. The pump 420 shown in FIGS. 4A-4C includes three sets of cylinders 421 and pistons 422. While three sets are shown, the pump 420 may include one, two, or more than three sets of cylinders 421 and pistons 422 arranged within the housing 450 without departing from the scope of the disclosure.

Each piston 422 may be axially fixed to the housing 450. Each piston 422 is partially disposed within a respective cylinder 421, and each piston 422 is stroked relative to respective cylinders 421. Referring to FIG. 4C, an intake stroke of the piston 422 causes mud 136 to enter the cylinder 421 through an inlet 425. The inlet 425 may include a filter and a check valve that inhibits flow out of the inlet 425 during a downstroke of the piston 422. The downstroke of the piston 422 pumps the mud 136 within the cylinder 421 out of an outlet 426 of the cylinder 421 and into a conduit 470 fluidly coupled to the high-pressure nozzles 266. The outlet 426 may include a check valve (not shown) that inhibits backflow into the cylinder 421 during the intake stroke. The conduit 470 fluidly couples the outlet 426 of each cylinder 421 to the second flow path 465 of the drill bit 154. In some embodiments, the conduit 470 is disposed in the housing 450. As shown in FIG. 4C, the conduit 470 has several branches that converge to a common conduit 471, with each branch extending from a respective outlet 426. In some embodiments, the conduit 470 may extend through a bracket 454 disposed in a bore of the housing 450 that is configured to engage the drill bit 154.

The pistons 422 are arranged around and attached together by a follower block 423. The cylinders 421 are similarly arranged around and attached together by a lower block 424. A self-reversing screw 427 extends through the follower block 423 into the lower block 424. The self-reversing screw 427 is rotatable about an axis relative to the follower block 423, lower block 424, the cylinders 421, and the pistons 422. The axis of rotation of the self-reversing screw may be coaxial with or offset from a longitudinal axis of the pump sub 400. The lower block 424 may include one or more bearings to facilitate the rotation of the self-reversing screw 427. The rotation of the self-reversing screw 427 causes the follower block 423 and pistons 422 attached thereto to reciprocate relative to the cylinders 421 between the uphole position shown in FIG. 4A and a downhole position shown in FIG. 4B.

The self-reversing screw 427 includes first and second thread profiles **428*a,b*, e.g., right and left handed thread profiles. The first and second thread profiles 428*a,b* may be machined into the self-reversing screw 427. The follower block 423 includes a follower that is engaged with the self-reversing screw 427. As the self-reversing screw 427 rotates, the follower block 423 tracks the first thread profile 428*a* which results in the downhole movement (e.g., downstroke or discharge stroke) of the pistons 422 from the uphole position toward the downhole position. The follower block 423 shifts from the first thread profile 428*a* to the second thread profile 428*b* when the downhole position is reached. Continued rotation of the self-reversing screw 427 causes the follower block 423 to track the second thread profile 428*b*, which results in the uphole motion (e.g., upstroke) of the piston 422 from the downhole position toward the uphole position. The follower block 423 shifts back to the first thread profile 428*a* to repeat the downstroke once the uphole position is reached. The linear speed of the follower block 423, and thus the linear speed of the pistons 422, may be controlled by the rotational speed of the self-reversing screw 427 and the angle of the first and second thread profiles 428***a,b*. Thus, the flow rate from the cylinders 421 may be controlled by the rotational speed of the self-reversing screw 427 which may be controlled by the flow rate of the mud 136 through the power source 210.

In some embodiments, the pump sub 400 includes a torque limiter 440. The torque limiter 440 receives rotational power from a transmission (not shown) connected to a power source (not shown). The torque limiter 440 is configured to reduce or disconnect the transfer of rotary power (e.g., torque) once a torque threshold is reached. For example, the torque limiter 440 may connect to a transmission of a mud motor that is connected to the pump sub 400. A failure of the pump 420, such as failure of the self-reversing screw 427 or follower block 423, may increase the torque experienced by the rotor due the failed pump 420 impeding rotation of rotor. The torque limiter 440 may disconnect or reduce the power transmission from the transmission to the self-reversing screw 427 once the torque threshold is reached to allow the rotor to rotate relative to self-reversing screw 427. The torque limiter 440, therefore, allows for continued mud flow through the power source, such as a mud motor, in the event that the pump 420 fails or otherwise becomes stuck.

Figure 5:
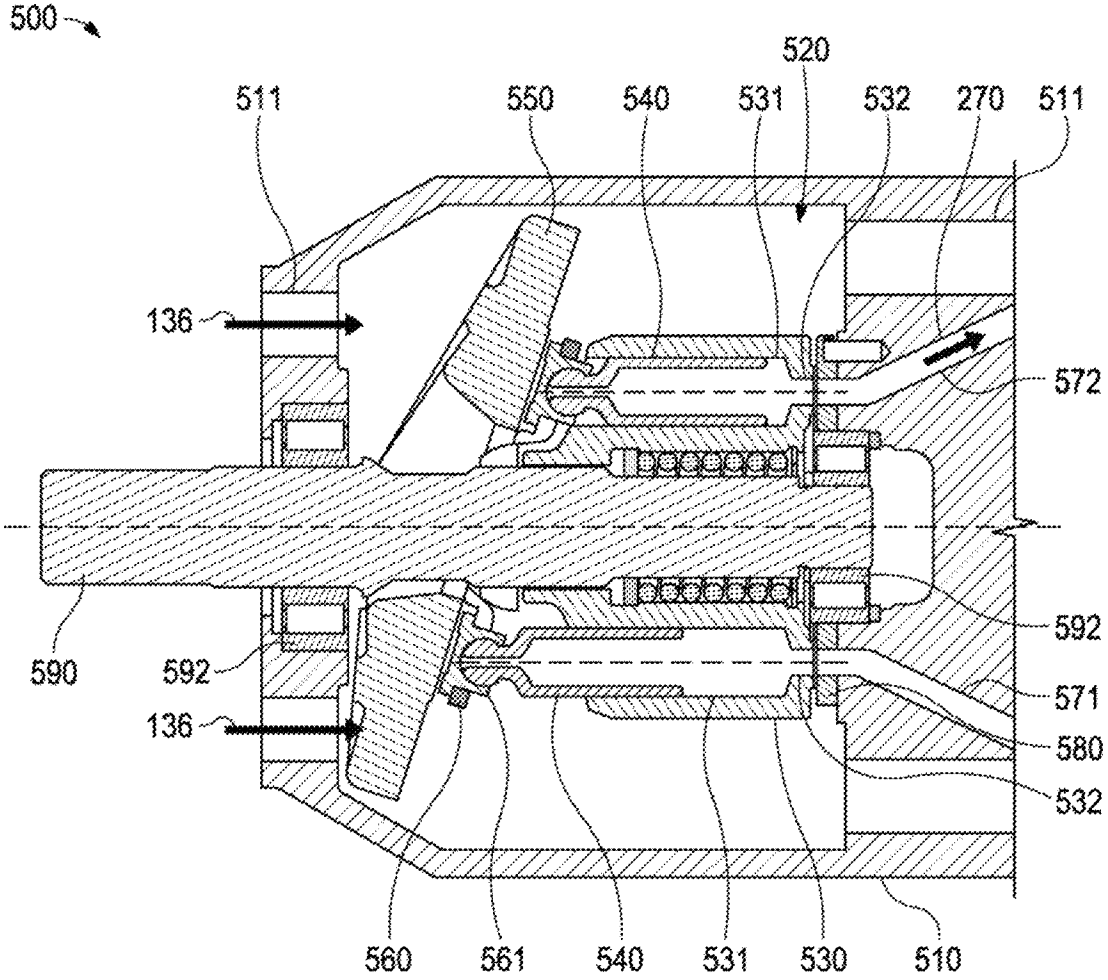
FIG. 5 is a partial cross-sectional view of a portion of an alternate embodiment of a pump sub in accordance with one or more exemplary embodiments of the disclosure.

FIG. 5 illustrates a cross-section of a portion of a pump sub 500 that may be incorporated into a BHA in accordance with one or more exemplary embodiments of the disclosure. The pump sub 500 may be incorporated into a drill string, such as drill string 150 (FIG. 1), and the rotation of the drill string may cause the rotation of the drill bit 154. The pump sub 500 may be connected to the power source 210 in FIG. 1. The pump sub 500 includes a swash pump 520 disposed within a housing 510. In some embodiments, the housing 510 includes a downhole coupling configured to receive the drill bit 154.

The housing 510 may include one or more flow paths 511 uphole and downhole of the swash pump 520 to allow the mud 136, represented by the arrow, to through the pump sub 500 toward the drill bit 154 (not shown). A portion of the mud 136 flows into the swash pump 520 is subsequently pumped as represented by arrow 270 into the second flow path 264 and ultimately out of the high-pressure nozzles 266 of the drill bit 154 at a discharge pressure. The remainder of the mud 136 flows past the swash pump 520 and is subsequently discharged from the low-pressure nozzles 264 of the drill bit 154.

The swash pump 520 is driven by rotary power provided by the power source operatively coupled to the swash pump 520. In some embodiments, the swash pump 520 is directly connected to a shaft 590 of the power source without need of a separate transmission. For example, the shaft 590 may be a rotor of a mud motor, an output shaft of a mud turbine, an output shaft of an electric motor, or an output shaft of a rotary solenoid. Rotation of the shaft 590 may be supported by one or more bearings, such as bearings 592 on opposing sides of the swash pump 520 as shown in FIG. 5.

The swash pump 520 includes a cylinder block 530 rotationally coupled to the shaft 590, a plurality of cylinders 540, and a swash plate 550. The swash plate 550 is rotationally fixed to the housing 510 and disposed at an angle relative to the cylinder block 530. The pistons 540 are engaged with the swash plate 550, and the pistons 540 are reciprocated as the cylinder block 530 is rotated relative to the swash plate 550.

The cylinder block 530 includes a piston bore 531 for each piston 540. The piston bore 531 includes an end aperture 532 that serves as an inlet during an intake stroke of the piston 540 and an outlet during a discharge stroke of the piston 540. In some embodiments, a biasing member (not shown) is disposed in the piston bore 531 to bias the piston 540 to an extended position to facilitate maintaining an engagement between the piston 540 and the swash plate 550.

In some embodiments, the pistons 540 may be connected to one another by a retainer plate 560 engaged with the swash plate 550, with each piston 540 being connected to the retainer plate 560 by a joint 561. In other embodiments, the swash pump 520 may not include a retainer plate 560. Rather, each piston 540 is engaged separately with the swash plate 550.

Rotation of the cylinder block 530 will cause an intake stroke of a piston 540. During an intake stroke, the end aperture 532 is aligned with an inlet flow path 571. The inlet flow path 571 may be partially defined by the housing 510. The inlet flow path 571 allows a portion of the mud 136 flowing through the pump sub 500 to enter into the piston bore 531 during the intake stroke of the piston 540. Continued rotation of the cylinder block 530 will eventually transition the piston 540 from the intake stroke to the discharge stroke, where the end aperture 532 becomes aligned with an outlet flow path 572 that is in fluid communication with the second flow path 265 of the drill bit 154. The mud 136 within the piston bore 532 is discharged during the downstroke of the piston 540 into the outlet flow path 572 which may be partially defined by the housing 510. In some embodiments, the inlet and outlet flow paths 571, 572 are partially defined by a valve plate 580 that facilitates a fluid connection with the piston bore 531 as the cylinder block 530 rotates.

Figure 6:
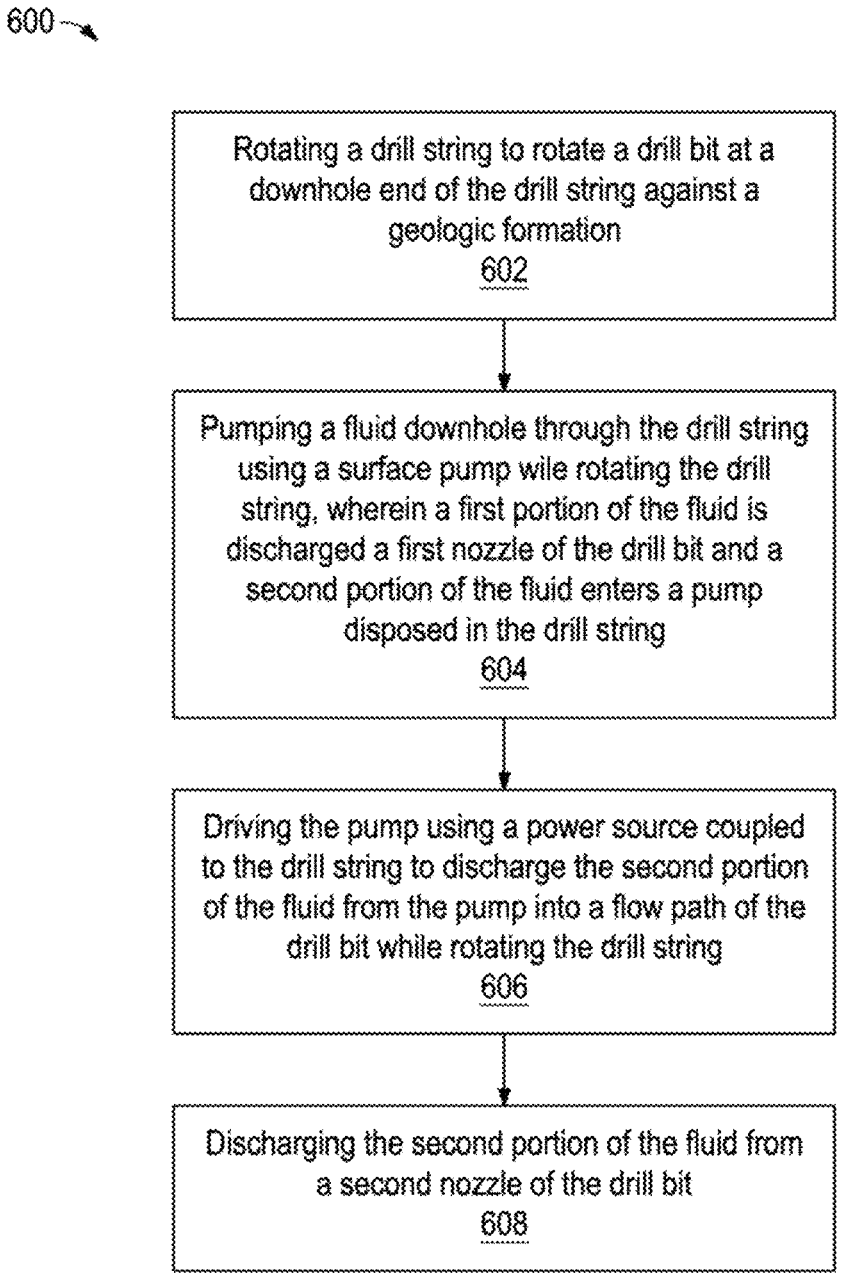
FIG. 6 is a schematic flow chart illustrating an example method of drilling a geologic formation.

FIG. 6 is a schematic flow chart illustrating an example method 600 of drilling a geologic formation. At operation 602, a drill string, such as drill string 150, is rotated to rotate a drill bit 154 at the downhole end of the drill string against the geologic formation. At operation 604, a fluid, such as mud 136, is pumped down the interior of the drill string via a surface pump 138 while the drill string is being rotated. A first portion of the fluid flows through the drill string and is subsequently discharged from one or more low-pressure nozzles 264. Additionally, a second portion of the fluid flowing through the drill string enters into a pump 220 disposed in the drill string 150. At operation 606, the pump 220 is driven using a power source 210 coupled to the drill string to discharge the second portion of the fluid from the pump into a flow path of the drill bit 154 while the drill string 150 is rotated. At operation 608, the second portion of the fluid is discharged from a high-pressure nozzle 266 of the drill bit 154. The pressurized fluid discharged from the high-pressure nozzle 266 releases stresses in the geologic formation ahead of the drill bit 154 to improve the rate of penetration of the drill bit 154. The discharge pressure of the pressurized fluid from the high-pressure nozzles may be at least 10,000 psi.

In some embodiments of method 600, the power source is a mud motor of the drill string, and the fluid flow through the drill string rotates a rotor of the mud motor to generate rotational power which is transferred to the pump by a transmission. In some embodiments of the method 600, the transfer of rotational power from the transmission to the pump is disconnected when a torque threshold is reached.

In one embodiment, a bottom hole assembly includes a housing, a drill bit, a pump, a power source, and a transmission. The drill bit is rotationally fixed to the housing such that rotation of the housing causes the drill bit to drill a geologic formation. The drill bit comprises a first flow path, a first nozzle in fluid communication with the first flow path, a second flow path, and a second nozzle in fluid communication with the second flow path. A first portion of a fluid flowing through the bottom hole assembly flows through the first flow path and exits the drill bit through the first nozzle. The pump is disposed in the housing. The pump comprises a cylinder axially fixed to the housing with an inlet and an outlet, a piston partially received within the cylinder, a self-reversing screw rotatable relative to the piston, and a follower block attached to the piston. The follower block reciprocates the piston relative to the cylinder in response to the rotation of the self-reversing screw to intake a second portion of the fluid into the cylinder through the inlet and discharge the second portion of the fluid from the outlet into the second flow path. The power source generates rotary power. The transmission is operable to transmit the rotary power to the self-reversing screw to drive the rotation of the self-reversing screw relative to the piston.

In some embodiments, the bottom hole assembly may further include a torque limiter interposing the transmission and the self-reversing screw. The torque limiter is configured to disconnect the from the transmission to the self-reversing screw when a torque threshold is reached.

In some embodiments of the bottom hole assembly, the power source is a mud motor or a mud turbine.

In some embodiments of the bottom hole assembly, the cylinder is a first cylinder and the piston is a first piston, and the pump further includes a second piston partially received in a second cylinder. The first and second pistons are attached to the follower block.

Embodiments disclosed herein include:

A. A bottom hole assembly includes a housing, a drill bit, a first flow path, a pump, a power source, and a second flow path. The housing being conveyable into a wellbore on a drill string and defining a flow channel therethrough for receiving a fluid from the drill string. The drill bit being coupled to the housing and operable to rotate to drill a geologic formation and thereby extend the wellbore. The first flow path being defined through the drill bit between a first inlet port and a first nozzle, the first inlet port fluidly coupled to the flow channel to permit a first portion of the fluid received from the drill string to flow through the first flow path and exit the drill bit through the first nozzle. The pump being disposed in the housing and having a pump inlet fluidly coupled to the flow channel to receive a second portion of the fluid received from the drill string, the pump being configured to pressurize the second portion of the fluid and discharge the second portion of the fluid through a pump outlet. The power source being coupled to the housing and operable to drive the pump. The second flow path being defined through the drill bit and distinct from the first flow path, the second flow path extending between a second inlet port and a second nozzle, the second inlet port fluidly coupled to the pump outlet to permit the pressurized second portion of the fluid to flow through the second flow path and exit the drill bit through the second nozzle.

B. A well system includes a drill string disposable in a wellbore, a housing, a drill bit, a first flow path, a pump, and a power source, and a second flow path. The housing being coupled to a downhole end of the drill string and defining a flow channel therethrough for receiving a fluid from the drill string. The drill bit being coupled to the housing and operable to drill a geologic formation and thereby extend the wellbore. The first flow path being defined through the drill bit between a first inlet port and a first nozzle, the first inlet port fluidly coupled to the flow channel to permit a first portion of the fluid received from the drill string to flow through the first flow path and exit the drill bit through the first nozzle. The pump being disposed in the housing and having a pump inlet fluidly coupled to the flow channel to receive a second portion of the fluid received from the drill string, the pump being configured to pressurize the second portion of the fluid and discharge the second portion of the fluid through a pump outlet. The power source being coupled to the housing and operable to drive the pump. The second flow path being defined through the drill bit and distinct from the first flow path, the second flow path extending between a second inlet port and a second nozzle, the second inlet port fluidly coupled to the pump outlet to permit the pressurized second portion of the fluid to flow through the second flow path and exit the drill bit through the second nozzle.

C. A method of drilling a geologic formation includes rotating a drill string to rotate a drill bit at a downhole end of the drill string against the geologic formation. The method further includes pumping a fluid downhole through the drill string using a surface pump while rotating the drill string. The method further includes discharging a first portion of the fluid from a first nozzle of the drill bit at a first discharge pressure. The method further includes flowing a second portion of the fluid into a pump disposed in the drill string. The method further includes driving the pump using a power source coupled to the drill string to thereby discharge the second portion of the fluid from the pump into a flow path of the drill bit while rotating the drill string. The method further includes discharging the second portion of the fluid from a second nozzle of the drill bit at a second discharge pressure greater than the first discharge pressure.

Each of embodiments A, B, and C may have one or more of the following additional elements in any combination:

Element 1: the power source is a mud motor including a stator, a rotor operable to rotate relative to the stator in response to fluid flow through the mud motor, and wherein the bottom hole assembly further comprises: a transmission operable to transfer rotational power of the rotor to the pump, and a torque limiter operably coupled between the transmission and the pump configured to permit rotation of the rotor relative to the pump when a predetermined torque threshold is reached. Element 2: the pump is a reciprocating pump, and wherein the bottom hole assembly further comprises a transmission interposing the power source and the pump, the transmission being configured to convert a rotational output provided by the power source to a reciprocating motion to drive reciprocation of the pump. Element 3: the reciprocating pump is a reciprocating piston pump partially receiving the drill bit, the reciprocating piston pump and the drill bit partially defining an interior pump chamber in fluid communication with the second flow path, wherein the reciprocating piston pump reciprocates relative to the drill bit in response to the reciprocating motion of the transmission to thereby discharge the second portion of the fluid from the interior pump chamber out of the second nozzle through the second flow path. Element 4: at least one seal element sealing an interface between the reciprocating pump and the drill bit. Element 5: the power source is a mud motor or a mud turbine. Element 6: a bypass conduit including a first end coupled to the pump inlet downhole of the power source and a second end arranged uphole of an intake of the power source. Element 7: the pump comprises a cylinder axially fixed to the housing; a piston partially received within the cylinder; a self-reversing screw rotatable relative to the piston in response to the power source; and a follower block attached to the piston, wherein the follower block reciprocates the piston relative to the cylinder in response to the rotation of the self-reversing screw. Element 8: a transmission configured to transmit power from the power source to the self-reversing screw; and a torque limiter interposing the transmission and the self-reversing screw, wherein the torque limiter is configured to disconnect power transmission from the transmission to the self-reversing screw when a torque threshold is reached. Element 9: the pump comprises a swash pump including a cylinder block rotationally coupled to the power source, a swash plate disposed at an angle relative to the cylinder block and rotationally fixed to the housing, and a piston engaged with the swash plate and received in a piston bore defined in the cylinder block that includes an end aperture, the end aperture being the pump inlet during an intake stroke of the piston and being the pump outlet in fluid communication with the second flow path during a discharge stroke of the piston. Element 10: the power source is at last one of an electric motor, a solenoid, a mud motor, or a mud turbine. Element 11: the pump is at least one of a reciprocating pump, a swash pump, a screw pump, an internal gear pump, an external gear pump, a rotary vane, a plunger pump, a diaphragm pump, or a circumferential piston pump. Element 12: the power source generates rotary power; and the pump comprises a cylinder axially fixed to the housing an including the pump inlet and the pump outlet, a piston partially received within the cylinder, a self-reversing screw rotatable relative to the piston in response to the power source, and a follower block attached to the piston, wherein the follower block reciprocates the piston relative to the cylinder in response to the rotation of the self-reversing screw to intake a second portion of the fluid into the cylinder through the pump inlet and discharge the second portion of the fluid from the outlet into the second flow path. Element 13: the cylinder is a first cylinder and the piston is a first piston, and wherein the pump further comprises a second piston partially received in a second cylinder, the first and second pistons being attached to the follower block. Element 14: a torque limiter interposing the transmission and the self-reversing screw, and wherein the torque limiter is configured to reduce rotary power transmission from the transmission to the self-reversing screw when a torque threshold is reached. Element 15: the power source is a mud motor, the method further comprising: rotating a rotor of the mud motor coupled to the drill string in response to fluid flow through the mud motor to generate rotational power; and transferring the rotational power to the pump through a transmission coupled to the pump. Element 16: disconnecting the transfer of rotational power from the transmission to the pump when a predetermined torque threshold is reached. Element 17: transferring the rotational power to the pump through the transmission comprises converting the rotational power to a linear movement with the transmission to thereby reciprocate the pump.

By way of non-limiting example, exemplary combinations applicable to A, B, and C include: Element 2 with Element 3; Element 7 with Element 8, Element 12 with Element 13, and element 15 with Element 16.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A bottom hole assembly, comprising:

a housing conveyable into a wellbore on a drill string and defining a flow channel therethrough for receiving a fluid from the drill string;

a drill bit coupled to the housing and rotatable to drill a geologic formation and thereby extend the wellbore;

a first flow path defined through the drill bit between a first inlet port and a first nozzle, the first inlet port being fluidly coupled to the flow channel to permit a first portion of the fluid received from the drill string to flow through the first flow path and exit the drill bit through the first nozzle;

a pump disposed in the housing and having a pump inlet in fluid communication with the flow channel to receive a second portion of the fluid received from the drill string, the pump being configured to pressurize the second portion of the fluid and discharge the second portion of the fluid through a pump outlet;

a power source coupled to the housing and operable to drive the pump, wherein the power source is a mud motor including a stator and a rotor operable to rotate relative to the stator in response to fluid flow through the mud motor;

a transmission operable to transfer rotational power of the rotor to the pump;

a torque limiter operably coupled between the transmission and the pump configured to permit rotation of the rotor relative to the pump when a predetermined torque threshold is reached; and a second flow path defined through the drill bit separate from the first flow path, the second flow path extending between a second inlet port and a second nozzle, the second inlet port being fluidly coupled to the pump outlet to permit the pressurized second portion of the fluid to flow through the second flow path and exit the drill bit through the second nozzle.

2. The bottom hole assembly of claim 1, wherein the pump is a reciprocating pump and the transmission interposes the power source and the pump, and wherein the transmission transfers the rotational power of the rotor to the pump by converting the rotational power to a reciprocating motion to drive reciprocation of the pump.

3. The bottom hole assembly of claim 2, wherein the reciprocating pump is a reciprocating piston pump partially receiving the drill bit, the reciprocating piston pump and the drill bit partially defining an interior pump chamber in fluid communication with the second flow path, wherein the reciprocating piston pump reciprocates relative to the drill bit in response to the reciprocating motion of the transmission to thereby discharge the second portion of the fluid from the interior pump chamber out of the second nozzle through the second flow path.

4. The bottom hole assembly of claim 3, further comprising at least one seal element sealing an interface between the reciprocating pump and the drill bit.

5. The bottom hole assembly of claim 1, further comprising a bypass conduit including a first end coupled to the pump inlet downhole of the power source and a second end arranged uphole of an intake of the mud motor.

6. The bottom hole assembly of claim 1, wherein the pump comprises:

a cylinder axially fixed to the housing;

a piston partially received within the cylinder;

a self-reversing screw rotatable relative to the piston in response to the power source; and a follower block attached to the piston, wherein the follower block reciprocates the piston relative to the cylinder in response to the rotation of the self-reversing screw.

7. The bottom hole assembly of claim 6, wherein the transmission is configured to transmit power from the power source to the self-reversing screw; and the torque limiter interposes the transmission and the self-reversing screw, wherein the torque limiter is configured to disconnect power transmission from the transmission to the self-reversing screw when a torque threshold is reached.

8. The bottom hole assembly of claim 1, wherein the pump comprises a swash pump including:

a cylinder block rotationally coupled to the power source;

a swash plate disposed at an angle relative to the cylinder block and rotationally fixed to the housing; and a piston engaged with the swash plate and received in a piston bore defined in the cylinder block that includes an end aperture, the end aperture being the pump inlet during an intake stroke of the piston and being the pump outlet in fluid communication with the second flow path during a discharge stroke of the piston.

9. A well system, comprising:

a drill string conveyable into a wellbore;

a housing coupled to a downhole end of the drill string and defining a flow channel therethrough for receiving a fluid from the drill string;

a drill bit coupled to the housing and operable to drill a geologic formation and thereby extend the wellbore;

a first flow path defined through the drill bit between a first inlet port and a first nozzle, the first inlet port being in fluid communication with the flow channel to permit a first portion of the fluid received from the drill string to flow through the first flow path and exit the drill bit through the first nozzle;

a pump disposed in the housing and having a pump inlet in fluid communication with the flow channel to receive a second portion of the fluid received from the drill string, the pump being configured to pressurize and discharge the second portion of the fluid through a pump outlet, wherein the pump comprises:

a cylinder axially fixed to the housing and including the pump inlet and the pump outlet;

a piston partially received within the cylinder;

a self-reversing screw rotatable relative to the piston; and a follower block attached to the piston;

a power source coupled to the housing and operable to drive the pump, wherein the power source generates rotary power, and the self-reversing screw rotates in response to the power source; and a second flow path defined through the drill bit and separate from the first flow path, the second flow path extending between a second inlet port and a second nozzle, the second inlet port being in fluid communication with the pump outlet to permit the pressurized second portion of the fluid to flow through the second flow path and exit the drill bit through the second nozzle, wherein the follower block reciprocates the piston relative to the cylinder in response to the rotation of the self-reversing screw to intake a second portion of the fluid into the cylinder through the pump inlet and discharge the second portion of the fluid from the pump outlet into the second flow path.

10. The wellbore system of claim 9, wherein the cylinder is a first cylinder, and the piston is a first piston, and wherein the pump further comprises a second piston partially received in a second cylinder, the first and second pistons being attached to the follower block.

11. The bottom hole assembly of claim 9, further comprising a torque limiter interposing the transmission and the self-reversing screw, and wherein the torque limiter is configured to reduce rotary power transmission from the transmission to the self-reversing screw when a torque threshold is reached.

12. A method of drilling a geologic formation, comprising:

rotating a drill string to rotate a drill bit at a downhole end of the drill string against the geologic formation;

pumping a fluid downhole through the drill string using a surface pump while rotating the drill string;

discharging a first portion of the fluid from a first nozzle of the drill bit at a first discharge pressure;

flowing a second portion of the fluid into a pump disposed in the drill string;

rotating a rotor of a mud motor coupled to the drill string in response to fluid flow through the mud motor to generate rotational power; and transferring the rotational power to the pump through a transmission coupled to the pump to drive the pump to thereby discharge the second portion of the fluid from the pump into a flow path of the drill bit while rotating the drill string;

discharging the second portion of the fluid from a second nozzle of the drill bit at a second discharge pressure greater than the first discharge pressure; and disconnecting the transfer of rotational power from the transmission to the pump when a predetermined torque threshold is reached.

13. The method of claim 12, wherein transferring the rotational power to the pump through the transmission comprises converting the rotational power to a linear movement with the transmission to thereby reciprocate the pump.

* * * * *